United States Patent [19]

Abouav

[11] Patent Number: 4,869,171

[45] Date of Patent: Sep. 26, 1989

[54] DETONATOR

[75] Inventor: David M. Abouav, Victoria, Australia

[73] Assignee: D J Moorhouse and S T Deeley, Victoria, Australia

[21] Appl. No.: 46,981

[22] PCT Filed: Jun. 20, 1986

[86] PCT No.: PCT/AU86/00176

§ 371 Date: Feb. 26, 1987

§ 102(e) Date: Feb. 26, 1987

[87] PCT Pub. No.: WO87/00264

PCT Pub. Date: Jan. 15, 1987

[30] Foreign Application Priority Data

| | | | |
|---|---|---|---|
| Jun. 28, 1985 | [AU] | Australia | PH 1253 |
| Jun. 28, 1985 | [AU] | Australia | PH 1254 |
| Jun. 28, 1985 | [AU] | Australia | PH 1255 |
| Jun. 28, 1985 | [AU] | Australia | PH 1256 |
| Jun. 28, 1985 | [AU] | Australia | PH 1258 |
| Jun. 28, 1985 | [AU] | Australia | PH 1259 |

[51] Int. Cl.[4] ..... F42C 11/00; F42C 19/12

[52] U.S. Cl. ..... 102/215; 102/206

[58] Field of Search ..... 102/200, 202.5, 206, 102/215, 301, 311, 331, 332

[56] References Cited

U.S. PATENT DOCUMENTS

| | | | |
|---|---|---|---|
| 3,262,388 | 7/1966 | McCarty | 102/206 |
| 3,329,092 | 7/1967 | Bassie | 102/206 |
| 3,999,076 | 12/1976 | Heckelman | 307/41 |
| 4,099,467 | 7/1978 | MacKellar et al. | 102/217 |
| 4,100,978 | 7/1978 | Boop | 102/21.6 |
| 4,136,617 | 1/1979 | Fowler | 102/206 |
| 4,145,970 | 3/1979 | Hedberg et al. | 102/206 |
| 4,576,093 | 3/1986 | Snyder | 102/200 |
| 4,615,268 | 10/1986 | Nakano et al. | 102/200 |
| 4,674,047 | 6/1987 | Tyler et al. | 102/200 |

FOREIGN PATENT DOCUMENTS

| | | |
|---|---|---|
| 0098779 | 1/1984 | European Pat. Off. . |
| 0147688 | 7/1985 | European Pat. Off. . |
| 866922 | 2/1953 | Fed. Rep. of Germany . |
| 953052 | 12/1956 | Fed. Rep. of Germany . |
| 3114234 | 11/1982 | Fed. Rep. of Germany . |
| 375536 | 6/1932 | United Kingdom . |
| 534689 | 3/1941 | United Kingdom . |
| 842043 | 7/1960 | United Kingdom . |
| 874332 | 8/1961 | United Kingdom . |
| 1526634 | 9/1978 | United Kingdom . |
| 2014380 | 8/1979 | United Kingdom . |
| 2015791 | 9/1979 | United Kingdom . |
| 2020119 | 11/1979 | United Kingdom . |

*Primary Examiner*—Charles T. Jordan

*Attorney, Agent, or Firm*—Cushman, Darby & Cushman

[57] ABSTRACT

A detonator of the type comprising an electrically-fired fusehead in an explosive charge comprises a conditioning means which has two states, normal and armed, and a control means for effecting a change from normal to armed state. The detonator cannot be fired when the conditioning means is in the normal state, and the control means may comprise electronic circuitry for recognizing and acting only on appropriate control signals. Accidental and unauthorized firing can thus be eliminated. Other embodiments include an actuator incorporating a delay capable of remote precise calibration and a safety device for reducing still further any risks involved when using these detonators in blasting operations. The detonator is preferably in modular form wherein the coupling together of the detonator, actuator, power unit, etc. forms the necessary electrical connections.

20 Claims, 19 Drawing Sheets

106
CONNECTOR
108
102
104
96
94
86
84
Vcc
122
118
Q7
Q6
Q5
Q4
Q3
Q2
Q1
Q0
138
128
130
126
124
136
132
134
120
112
RELAY
110
116
114
117
62
FUSIBLE ELEMENT
113
115

FIG. 9.

CONNECTION TABLE FOR FIGURE 8 CIRCUIT

| No. (Unit type) | 208 (8085) | 210 (8155) | 212 ($2716_D$) | 216 ($74377_{IN}$) | 216 ($74377_{OUT}$) | 212 ($2716_A$) |
|---|---|---|---|---|---|---|
| AD0 | 12 | 12 | 9 | 3 | 2 | 8 |
| AD1 | 13 | 13 | 10 | 4 | 5 | 7 |
| AD2 | 14 | 14 | 11 | 7 | 6 | 6 |
| AD3 | 15 | 15 | 13 | 8 | 9 | 5 |
| AD4 | 16 | 16 | 14 | 13 | 12 | 4 |
| AD5 | 17 | 17 | 15 | 14 | 15 | 3 |
| AD6 | 18 | 18 | 16 | 17 | 16 | 2 |
| AD7 | 19 | 19 | 17 | 18 | 19 | 1 |
| A 8 | 21 | | | | | 23 |
| A 9 | 22 | | | | | 22 |
| A10 | 23 | | | | | 19 |

START
218
Make det. safe
220
Wait for command
222
Inf'm'tion request
yes
Transducer input
224
no
226
CALIBRATE command
no
yes
230
Start Calib. timer
232
Wait for command
234
BLAST code
no
yes
236
Calculate delay
238
Reply to Control 14
240
ARM det. unit 22
A
A
242
Set 5 sec. timer
244
t > 5 sec
yes
no
246
Rec'd command
yes
no
248
BOOM command ?
no
yes
250
Get calc'd delay
252
Wait delay
258
Actuate fusehead
260
Still alive ?
yes
262
Tell master 'not OK'

FIG. 16.

CONNECTION TABLE FOR FIGURE 15 CIRCUIT

| No. (Unit type) | 392 (8085) | 396 (8155) | 394 ($2716_D$) | 400 ($74377_{IN}$) | 400 ($74377_{OUT}$) | 394 ($2716_A$) |
|---|---|---|---|---|---|---|
| AD0 | 12 | 12 | 9 | 3 | 2 | 8 |
| AD1 | 13 | 13 | 10 | 4 | 5 | 7 |
| AD2 | 14 | 14 | 11 | 7 | 6 | 6 |
| AD3 | 15 | 15 | 13 | 8 | 9 | 5 |
| AD4 | 16 | 16 | 14 | 13 | 12 | 4 |
| AD5 | 17 | 17 | 15 | 14 | 15 | 3 |
| AD6 | 18 | 18 | 16 | 17 | 16 | 2 |
| AD7 | 19 | 19 | 17 | 18 | 19 | 1 |
| A 8 | 21 | | | | | 23 |
| A 9 | 22 | | | | | 22 |
| A10 | 23 | | | | | 19 |

FIG. 20.

CONNECTION TABLE FOR FIGURE 19 CIRCUIT

| No. (Unit type) | 438 (8085) | 442 (8155) | 440 ($2716_D$) | 446 ($74377_{IN}$) | 446 ($74377_{OUT}$) | 440 ($2716_A$) |
|---|---|---|---|---|---|---|
| AD0 | 12 | 12 | 9 | 3 | 2 | 8 |
| AD1 | 13 | 13 | 10 | 4 | 5 | 7 |
| AD2 | 14 | 14 | 11 | 7 | 6 | 6 |
| AD3 | 15 | 15 | 13 | 8 | 9 | 5 |
| AD4 | 16 | 16 | 14 | 13 | 12 | 4 |
| AD5 | 17 | 17 | 15 | 14 | 15 | 3 |
| AD6 | 18 | 18 | 16 | 17 | 16 | 2 |
| AD7 | 19 | 19 | 17 | 18 | 19 | 1 |
| A 8 | 21 | | | | | 23 |
| A 9 | 22 | | | | | 22 |
| A10 | 23 | | | | | 19 |

DETONATOR

TECHNICAL FIELD

This invention relates to a detonator.

BACKGROUND ART

Known detonators usually comprise a housing containing an explosive charge with a pair of fusehead conductors; passage of a current through these conductors causes the detonator to explode. Whilst this construction of detonator has the advantage of simplicity, it has very serious disadvantages from the point of view of safety and also from the point of view of ease of unauthorised use.

The main problem from the point of view of safety is that the detonators are susceptible to inadvertent operation because the fusehead conductors can pick up stray electromagnetic radiation or induced currents due to magnetic or electric fields. Handling of known detonators can therefore be somewhat hazardous.

From the point of view of security, known detonators suffer from the disadvantage that they can be actuated by any electrical device which supplies sufficient electrical current to the fusehead conductors. Thus, the detonators can be used for illegal purposes if they fall into the wrong hands.

DISCLOSURE OF INVENTION

It is an object of the present invention to provide a detonator which is incapable of actuation unless control signals of a predetermined form are applied thereto. Further objects of this invention are to provide a detonator of a particular construction and a blasting system which utilises such detonators.

According to the present invention there is provided a detonator comprising housing means, an explosive charge located within the housing means, fusehead conductors extending from the explosive charge, conditioning means in the fusehead conductors, the conditioning means being operable, in a normal state, to render the fusehead conductors incapable of carrying a voltage or current sufficient to cause explosion of the explosive charge, and control means responsive to control signals applied thereto and operable to change the state of the conditioning means to an armed state, in response to receipt of a predetermined control signal, wherein the fusehead conductors are capable of carrying a voltage or current sufficient to cause explosion of the explosive charge.

Most of the components of the detonator according to this invention are well-known to the art. For example, the housing may be constructed from any material known to be suitable for this purpose, such as aluminum, steel or carbon-filled rubber. The explosive charge used normally in the detonator can again be any type of explosive used for such purposes, for example, lead azide, lead styphnate or pentaerythritol tetranitrate. Mixtures of one or more of these explosives are used by the art and may also be used in the detonators according to this invention.

The fusehead conductors are of conventional type and are joined within the explosive charge by a fusible element. When an electric current is passed between the conductors, the element fuses and sets off the explosive. Other initiating fuseheads include exploding bridgewire and "flying-plate" types.

The conditioning means operates such that in a normal, i.e. non-armed, state, the detonator cannot be accidentally or deliberately fired without first putting the conditioning means in an armed state by a predetermined control signal. It does this by rendering the fusehead conductors incapable of carrying an electric current. This can be achieved in a number of ways. For example, the conditioning means may short-circuit the fusehead conductors by connecting them to an earth wire, or more simply (and preferably) to the housing means.

The change to the armed state thus requires that the short circuit be removed. The selection of a particular type of short circuiting means will determine how this is achieved. For example, the conditioning means may comprise a relay the contacts of which are connected in the fusehead conductors and the operating coil of which is responsive to the control means. Preferably, the contacts connect the fusehead conductors to the housing in the normal state, and in the armed state form an electrical link which allows the fusehead conductors to carry current. Another type of removable short circuit is the fusible link. Such links may connect the fusehead conductors to the housing in the normal state, and the control means operates to fuse the links thus breaking the short circuit and changing the conditioning means to the armed state.

The control means changes the normal state to the armed state on receiving control signals to do so. The control means can therefore be any suitable means for achieving this. It may be integral with the detonator and included within the same housing, or it may be an independent unit wired to or otherwise physically attached to the detonator. It may incorporate within itself the means for effecting the change of state from normal to armed, or it may be separate therefrom. In an especially preferred embodiment, the control means comprises electronic logic circuitry for ascertaining whether an incoming signal is an appropriate control signal on which to act. This is an especially valuable embodiment in that it means that only an appropriate signal will allow detonation to take place, and that only deliberate action by a person having access to a predetermined control signal can fire the detonator. Accidental and unauthorised firing are therefore effectively prevented. A person skilled in the art will readily comprehend the type of circuitry needed. It may, for example, include a register holding a binary code.

In a preferred embodiment, the control signal originates from an actuator. By "actuator" I mean a unit whose function is to receive input signals from a remote control device, and, on receipt of predetermined input signals, to (a) generate an output "arm" signal which alters the state of the detonator from normal to armed state and (b) after a predetermined delay generate an output "actuate" signal to fire the detonator. The actuator thus incorporates the delay which is so essential to large scale commercial blasting. It is possible and permissible for the control means and the actuator to be integral, but I prefer that the actuator be separate from the control means, and more preferably that it be housed in an entirely separate unit. This unit may be wired to or otherwise physically connected to the detonator but in an especially preferred embodiment of my invention, the detonator and actuator comprise interconnectable housings which are connected prior to use. Such an arrangement further adds to the versatility and safety of the system. In one particularly preferred embodiment of this aspect of the invention, the detonator which contains the explosive charge can only be actuated when it is coupled to a complementary actuator. The detonator is thus useless without the complementary actuator.

The electronic circuitry within the actuator stores delay information and acts on an appropriate signal or appropriate signals from a remote command source to generate output arm and output actuate signals separated by a selected delay time. Preferably, the circuitry will comprise a microcomputer with a memory which stores both an arm code and an actuate code. The microcomputer analyses input signals, and when it identifies a predetermined signal or predetermined signals it then causes to be generated appropriate corresponding output arm and actuate signals.

The output arm and output actuate signals may be of any type suitable to actuate a detonator. They may be, for example, simple voltage or current signals. I prefer that they be in digital code; this adds considerable safety and security to the system in that it is most unlikely that a spurious voltage signal will trigger the detonator.

There are a number of possible forms in which an output signal can be sent. It can be, for example, a single signal which causes the actuator to generate the output arm signal followed after a predetermined delay by the output actuate signal. Alternatively, the signal can be a voltage step signal wherein the leading edge of the signal comprises an input arm signal and the trailing edge an input actuate signal. I prefer, however, to send input signals in binary code. Thus, input arm and input actuate signals may be incorporated in a single signal.

The specific length of delay may be built into the actuator during manufacture, but I prefer to have the delay programmable, that is, capable of being readily altered by electronic means. This confers considerable versatility on the system. Thus, an actuator may be programmed electronically prior to its being inserted in a blasthole. Even more versatility is conferred by having the actuator programmable when the detonator is actually in place in a charge of explosives via the means through which the input signals are transmitted. Thus, a blast pattern can be altered at will and in complete safety up to the time of sending of the input arm and input actuate signals.

The delay times can be set very precisely in the detonators according to this invention. A preferred way of doing this is by in situ calibration of timing using calibration signals. My invention encompasses a method of actuating a detonator by means of signals from a remote control device, the detonator having control circuitry which includes timing means and storage means for storing a predetermined delay, the method including the step of determining the output of the timing means in response to calibration start and calibration stop signals generated by the control device, determining a timing calibration factor by reference to that output and the time sequence of the calibration start and stop signals, and generating an actuate signal in the control device for exploding the detonator after a modified delay determined by the predetermined delay and the calibrating factor.

The remote control device may be a conventional exploder box such as a multi-channel exploder (MCE)-box. However, a preferred type of control device for the detonators according to this invention is described in my co-pending Australian patent application No. PH1257. My invention provides a blasting system which comprises a plurality of detonators as hereinabove described and a control device from which are sent control signals to the detonators.

Thus, in accordance with the invention, the detonators are calibrated against the control device prior to explosive operation thereof. It is preferred that the calibration step be carried out just prior to operation so that the effects of temperature and pressure acting on the detonator are substantially eliminated. This is an important practical consideration because frequently the detonators are located in blast holes where the temperature and pressure can be quite different from the atmosphere. Since the operation of the timing means of the detonator will in practice be susceptible to variation according to temperature and pressure, these variations can be eliminated by the method of the invention.

Further, the electric components which are used in the detonator need not have tight tolerances so that its timing means will run at a precisely known rate because calibration can eliminate the effects of variations. Thus, the manufacturing costs of th detonator can be kept low.

For the measurement of variables such as temperature and pressure at the bottom of blastholes in order to facilitate the operation of the detonator, especially with regard to the calibration of the actuator, the detonator preferably comprises a transducer unit. The transducer unit comprises at least one transducer element. This is a well-known type of electronic device, which is able from a selected physical parameter, such as temperature or pressure, to generate an electrical condition signal which can then be sent, for example, to a measuring instrument or used to make some adjustment to an apparatus affected by the parameter. In this case, the transducer signals may be used, for example, to alter the calibration of a detonator. This alteration can also be communicated back to the surface; the detonator is thus able to "talk back" to the operator on the surface. This feature is especially valuable when such a transducer-equipped detonator is used in conjunction with a control device as described in my co-pending Australian Patent Application PH1257.

The transducer unit of my invention is contained in a separate modular housing the attaching of which to the actuator or other unit makes all the appropriate electrical connections. The transducer unit will not couple directly to the detonator.

The power to drive the detonator may be provided by any convenient means, consistent with the fact that a detonator set to explode late in a series of blasts should not be prone to failure by the breakage by an earlier explosion of a wire connection thereto. The power source for the arming and actuating of the detonator should therefore be in close proximity to the detonator and preferably either enclosed within the detonator housing or capable of being connected to the detonator. The power source may be a battery, or preferably a temporary power source such as a capacitor which is charged by signals from the surface. In an especially preferred embodiment of my invention, the capacitor is housed in a separate modular unit which can be attached to the detonator and actuator units, such that they form an integral unit with the appropriate electrical connections established by the joining together of the individual modular nits.

The various instructions may be sent to the various detonators from the control device by means of wiring which connects each individual detonator to the control device, either directly or via the intermediary of an exploder box or several exploder boxes. Alternatively, instructions may be transmitted by radio. Thus, there could be associated with each detonator or group of detonators a radio transceiver which would receive broadcast instructions from the control device. This method has the considerable advantage that the complex, damage - prone wiring needed for large-scale blasting (where there are often hundreds of charges) can be largely avoided.

In large scale blasting of the type hereinabove described, there is always the danger that the actuate signal may be inadvertently given, or that a spurious signal may sufficiently resemble the predetermined actuate signal to cause arming or even detonation. This can be overcome by making the detonator responsive to control signals which prevent operation (hereinafter referred to as "safety signals"), and supplying a continuous stream of safety signals to the detonators until blasting is actually required. At this point the predetermined arm and actuate signals are sent.

This aspect of the invention is especially useful when radio communication is being used, radio being particularly susceptible to picking up spurious signals. The apparatus which generates the safety signals may be part of a central control device whose main function is to arm and explode the detonators. I prefer, however, that in the case of radio communication, it be an entirely separate unit with its own transceiver. Thus, such a safety signal generating apparatus may be set up initially at a blasting site and switched on to provide complete safety during blasthole loading operations. The separate nature of the apparatus has the added advantage that a failure in the controller will not cause the apparatus to fail.

The invention is further described with reference to the following drawings:

BRIEF DESCRIPTION OF DRAWINGS

FIG. 9 is a connection table showing the connections of the components of FIG. 8;

FIG. 16 is a connection table showing the connections of the components of FIG. 15;

FIG. 20 is a connection table showing the connection of the components of FIG. 15.

MODES FOR CARRYING OUT THE INVENTION

Figure 1:
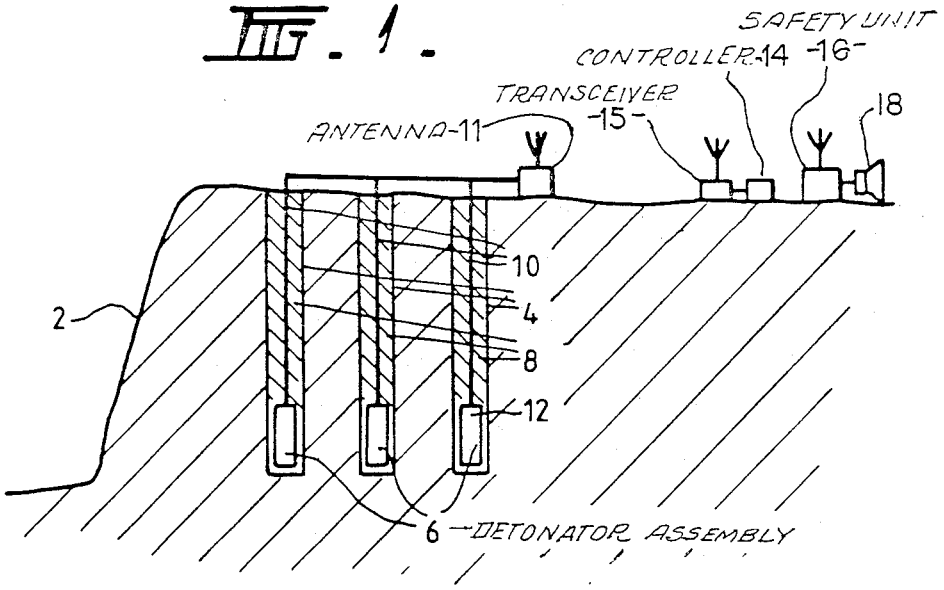
FIG. 1 is a schematic view of a quarry having a plurality of charges arranged to be activated by remote control.
Figure 2:
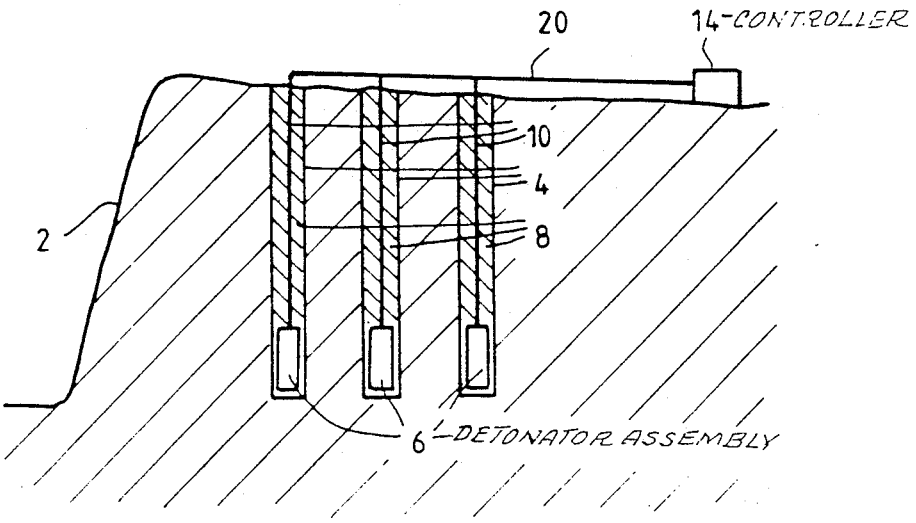
FIG. 2 is a similar view but showing an arrangement in which the charges are set off by a direct wire connection.

FIG. 1 shows a quarry face 2 and a number of charge holes 4 drilled into the ground behind the face. A detonator assembly 6 is located in each hole 4 and the remainder of the hole is filled with a bulk charge 8 such as ammonium nitrate fuel oil mixture which is supplied as a powder or slurry, in accordance with known practice. The detonator assemblies 6 are connected by conductors 10 to an antenna 11 for a radio transceiver 12 located in one or more of the assemblies 6 The transceiver 12 receives control signals from a controller 14 via a transceiver 15 so that the detonator assemblies can be actuated by remote control A site safety unit 16 may also be provided to provide additional safety during laying of the charges. The unit 16 is preferably located near the antenna 11 so as to be likely to pick up all signals received by the antenna 11. The safety unit 16 includes a loudspeaker 18 which is operated in emergency conditions and prior to a blast. The detonator assemblies 6 are arranged to be actuated at an accurately determined time after the controller 14 has transmitted signals for the blast to commence. The detonator assemblies 6 can be arranged to be activated in a precisely defined time sequence so that efficient use is made of the blasting materials. The number of blast holes 4 can of course be very considerable. For instance, in some large scale mining and quarrying operations up to 2000 holes are sometimes required in a single blasting operation FIG. 2 shows an arrangement which is similar to FIG. 1 except that communication from the controller 14 to the detonator assemblies 6 is via a wire 20 extending from the controller 14 to the conductors 10. In this case the safety unit 16 is not required because of the hard wire connection between the controller 14 and the detonator assemblies 6, but it could be coupled to the wires 20 so as to sound an alarm when signals are detected for causing actuation of the detonator assemblies.

Figure 3:
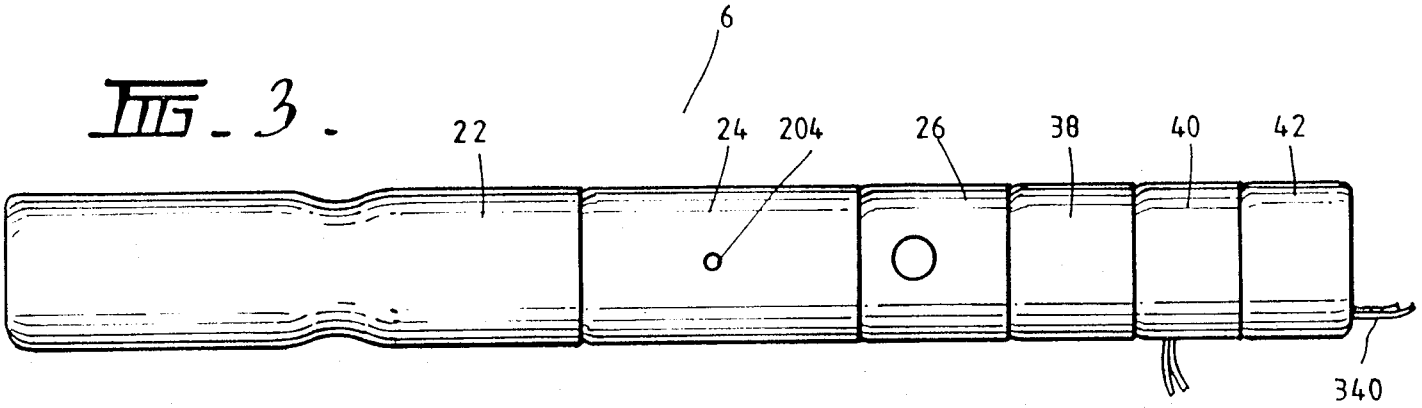
FIG. 3 is a side view of a detonator assembly.

FIG. 3 shows the detonator assembly 6 in more detail. As will be described hereinafter, it comprises a number of interconnected modules which can be varied in accordance with requirements. In the illustrated arrangement the modules comprise a detonator unit 22, an actuator unit 24, a transducer unit 26, a battery unit 38, an expander unit 40 and a connector unit 42. The units themselves can be made with various modifications as will be explained hereinafter. Generally speaking however a detonator assembly 6 in a useful configuration will include at least the following units: a detonator unit 22, an actuator unit 24, a battery unit 38 and a connector unit 42.

Figure 4:
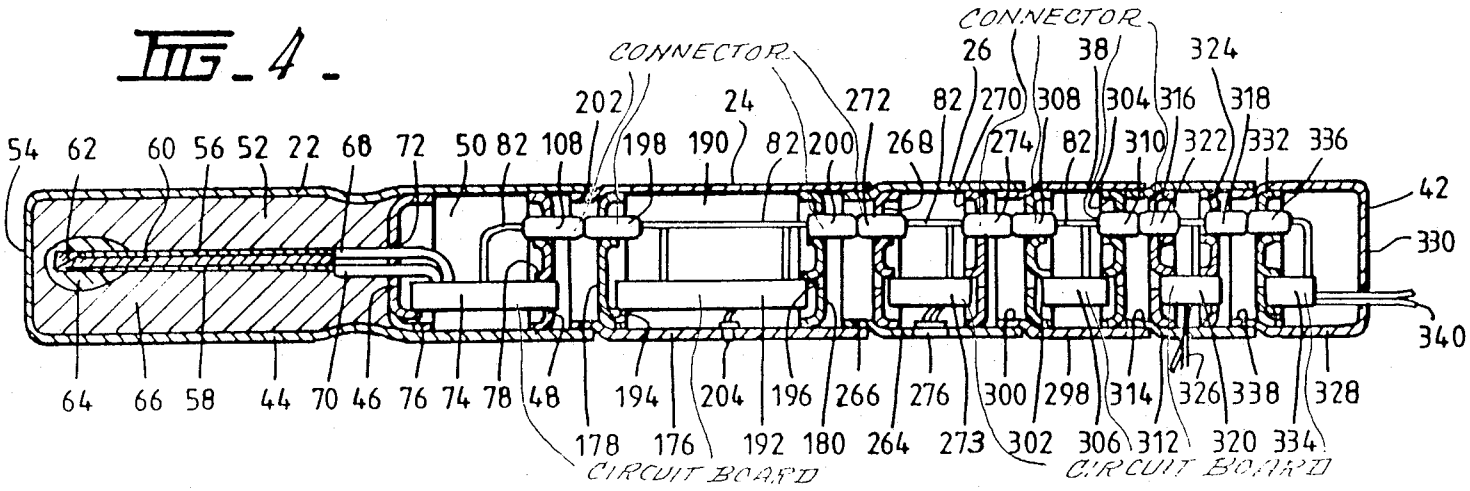
FIG. 4 is a schematic sectional view through the detonator assembly of FIG. 3.

FIG. 4 shows a longitudinal cross section through the detonator assembly 6 revealing in schematic form the physical layout of the components.

The detonator unit 22 comprises a tubular housing 44 which for instance might be formed from aluminium, or a resilient material which is a conductor such as carbonised rubber The housing 44 is provided with transverse partitions 46 and 48 press fit into the housing 44. A first chamber 50 is formed between the partitions 46 and 48 and a second chamber 52 is formed between the partition 46 and the closed end wall 54 of the housing. Extending into the second chamber 52 are two fusehead conductors 56 and 58 separated by an insulating block 60. The conductors 56 and 58 are connected to a fusible element 62 located within a flashing mixture charge 64. The remainder of the second chamber 52 is filled or partly filled with a base charge 66 of explosive material. The conductors 56 and 58 include insulated portions 68 and 70 which extend through an opening 72 in the partition 46 and into the first chamber 50.

Located within the first chamber 50 is a circuit board 74 which mounts electronic and/or electric components The board 74 is supported by tabs 76 and 78 pressed from the partitions 46 and 48. The partition 48 also supports a multiport connector 108 for a bus 82.

Figure 5:
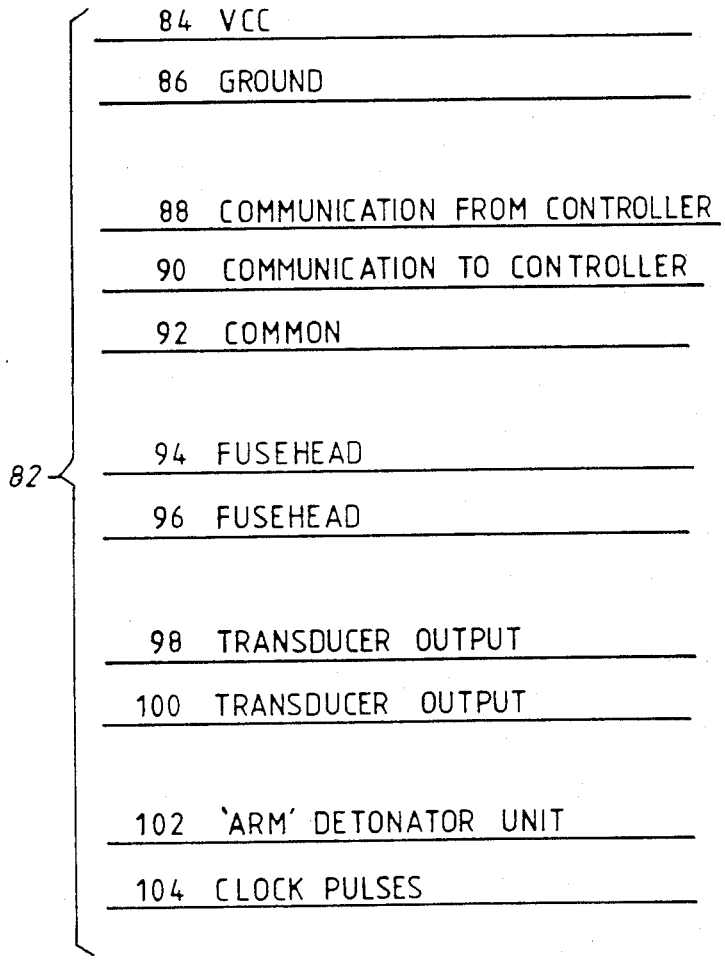
FIG. 5 is a schematic view of lines in a communication bus.

The bus 82 has multiple lines which enable electrical interconnection of the various modular units although not all of the lines are required for the functioning of particular units. FIG. 5 shows schematically the various lines in the bus 82 for the illustrated arrangement. In this case there are 11 lines 84, 86, 88, 90, 92, 94, 96, 98, 100, 102 and 104, some of which are required for the operation of the circuitry on the board 74 of the detonator unit 22.

Figure 6:
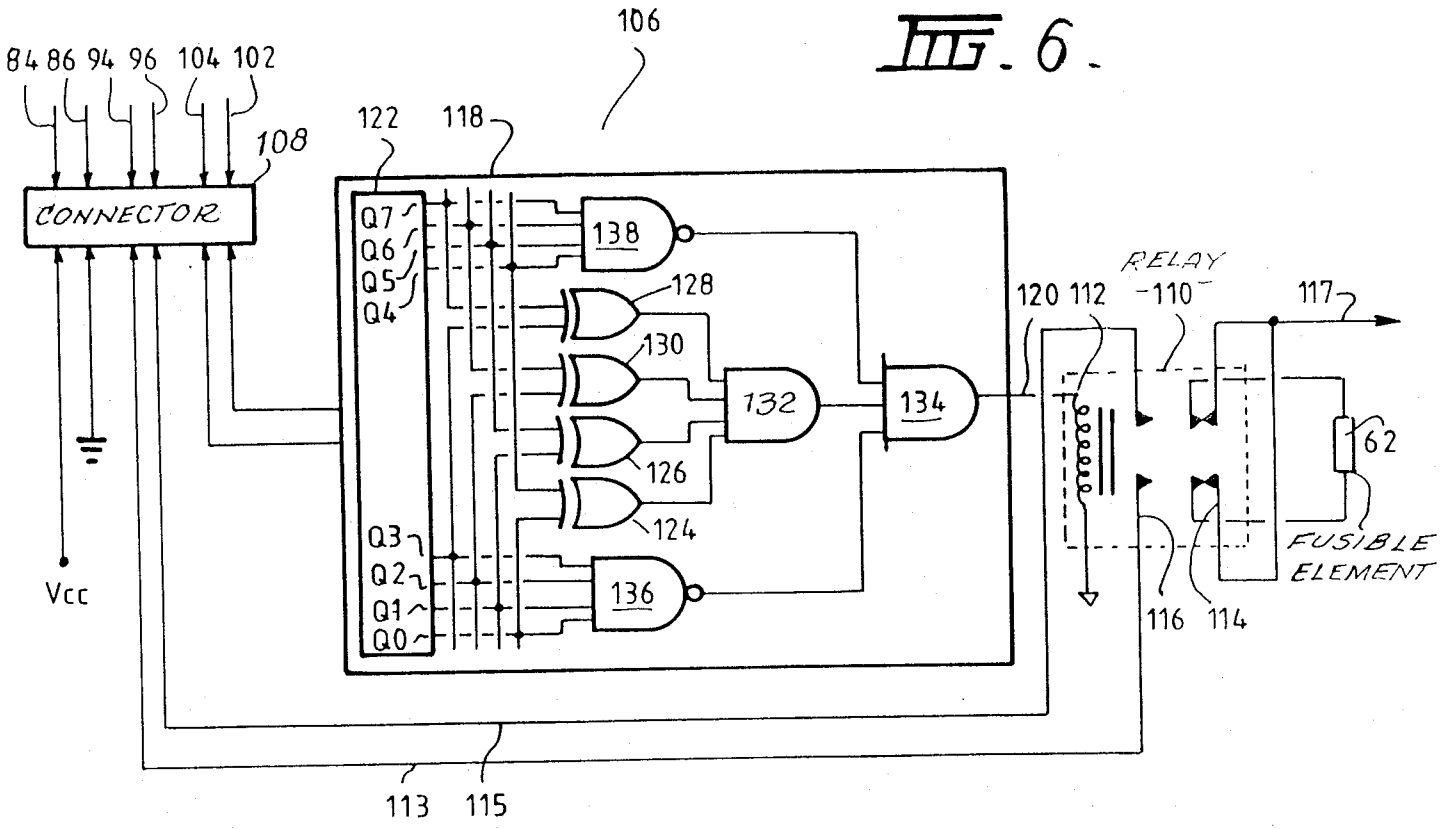
FIG. 6 shows the circuitry of one embodiment of a conditioning means according to the invention.

FIG. 6 illustrates diagrammatically a circuit 106 which is mounted on the board 74 of the unit 22. The circuit 106 includes a connector 108 which allows connection to selected lines in the bus 82. In the illustrated arrangement, the line 84 is a voltage supply line and the line 86 is a ground line for the supply. The lines 94 and 96 carry, at appropriate times, high currents which enable fusing of the fusing element 62. The line 104 carries clock pulses whereas the line 102 carries an ARM signal which places the detonator unit 22 in a "armed" state so that it can be activated on receipt of appropriate driving currents on the lines 92 and 96. In the illustrated arrangement, the signals and currents on the lines 94, 96, 102 and 104 are derived from the actuator unit 24. The power supply lines 84 and 86 are coupled to receive power from the battery unit 38.

The circuit 106 includes a relay 110 having a driving coil 112, normally closed contacts 114 and normally open contacts 116 which are connected to conductors 113 and 115 which are connected to the lines 94 and 96 via connector 108. The normally closed contacts 114 are connected by means of conductors 117 to the aluminium housing 44 so that both sides of the fusible elements 62 are shorted directly to the housing. This is an important safety factor because the detonator unit 22 cannot be activated unless the relay 110 is operated This protects the unit 22 from unwanted operation caused by stray currents or radio frequency electromagnetic radiation. In the illustrated arrangement, the relay 110 is not operated until just before signals are delivered to the lines 94 and 96 for activation of the detonator unit. The arrangement therefore has the advantage that until just prior to when the detonator unit 22 is activated, the fuse head conductors 56 and 58 cannot receive any electromagnetic or electrostatic charges which might inadvertently fuse the element 62.

The operating coil 112 of the relay is connected to a logic circuit 118 which receives input from lines 102 and 104 The preferred arrangement is that the circuit 118 must receive an ARM signal comprising a two part four bit code on the line 102 in order to produce an output on line 120 which activates the relay.

The circuit 118 includes a 74164 eight bit shift register 122 having eight output lines $Q_0$–$Q_7$. The circuit further includes four exclusive OR gates 124, 126, 128 and 130 connected to pairs of outputs from the shift register 122. The outputs of the exclusive OR gates are gated in a four input AND gate 132, the output of which is in turn connected to one input of a three input high current AND gate 134 The circuit further includes a four input NAND gate 136 connected to the first four outputs of the register 122 and a second NAND gate 138 connected to the second four outputs of the register 122. The outputs from the NAND gates 136 and 138 are connected to the remaining two inputs of the AND gate 134. The configuration of the gates connected to the outputs $Q_0$–$Q_7$ of the register 122 is such that only selected eight bit signals on the line 102 will cause a signal to appear on the output 120 for activating the relay. The signal must be such that the first four bits are exactly the complement of the second four bits and further the first four bits cannot be all 1's or all 0's. The latter requirements are important in practice because it prevents erroneous operation of the circuit 8 in the event that a circuit fault causing a high level or short circuit to be applied to the line 102. The circuit 106 illustrated above is given by way of example only and it would be apparent that many alternative circuits could be used. If at any time a signal is received on line 102 which is not an ARM signal the output line 120 will go low and deactivate the relay 110. The controller 14 may generate RESET signals for this purpose In any event the logic circuitry 118 will cause the output 120 to go low if any signal other than an ARM signal is received. The following are examples of valid ARM signals

00011110
10000111
01001011.

Further, the circuit 106 could be integrated if required, except for the relay.

Figure 7:
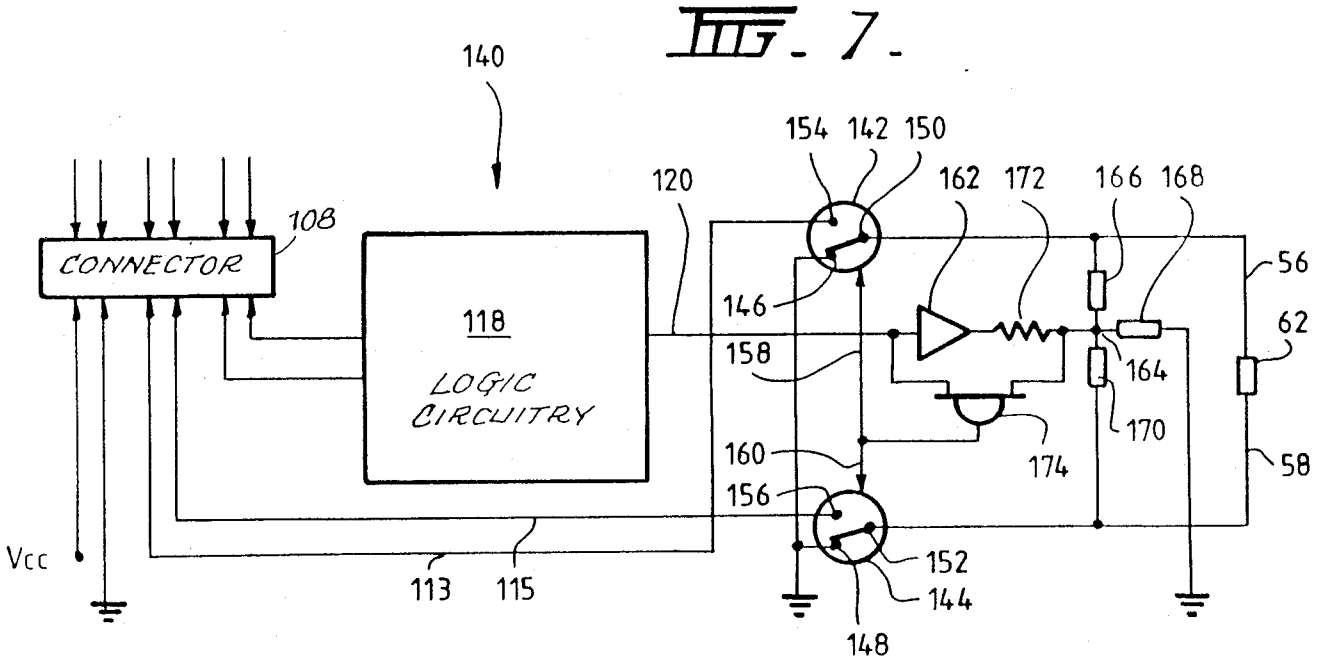
FIG. 7 shows the circuitry of another embodiment of a conditioning means.

FIG. 7 illustrates an alternative circuit 140 for the detonator unit 22 The inputs from the bus 82 to the connector 108 are the same as for the circuit 106 and the logic circuitry 118 is also the same as for the circuit 106. An alternative arrangement is however employed to ensure that the lines 94 and 96 are not electrically connected to the fusible element 62 until just prior to actuation on receipt of a correctly coded signal to the logic circuitry 118. In this arrangement, the circuit includes two solid state relays 142 and 144. The relays have electrodes 146 and 148 which are permanently connected to ground. The relays include electrodes 150 and 152 which are connected to the insulated portions of the conductors 56 and 58 leading to the fusible element 62 The relays are such that the electrodes 146 and 150 and the electrodes 148 and 152 are internally connected so that both conductors 56 and 58 are grounded and connected to the housing 44. The relays include electrodes 154 and 156 which are connected to the lines 94 and 96 via conductors 113 and 115. When the relays receive triggering signals on trigger electrodes 158 and 160 the internal connections change so that the electrodes 150 and 154 and the electrodes 152 and 156 are internally connected. In this case the conductors 56 and 58 are no longer grounded and are electrically connected to the lines 94 and 96 in readiness for activation of the fusible element 62. Triggering of the relays depends upon the output line 120 from the logic circuitry 118 as will hereinafter be explained.

The output line 120 from the circuitry 118 is connected to the input of an amplifier 162 which is connected to the junction 164 of three fusible links 166, 168 and 170 via a resistance 172. The circuit includes an AND gate 174 one input of which is connected to the output line 120 and the other input of which is connected to the junction 164. Output from the gate 174 is connected to the trigger terminals 158 and 160 of the relays. The arrangement is such that during normal operation both inputs to the gate 174 are low so that the relays are not triggered. When however a correctly coded signal is present on the line 102, the output line 20 of the circuitry 118 will go high to a sufficient extent whereby the fusible links 166, 168 and 170 will rupture. When all links have been ruptured the junction 64 will be high and hence the gates 174 will go high and the relays will be triggered. This couples the conductors 56 and 58 to the lines 94, 96 in readiness for actuation. It will be appreciated that until the logic circuitry 118 detects a correctly coded signal, the fusible element 62 is protected by the fusible links 166, 168 and 170. The arrangement prevents inadvertent charges or currents being developed in the conductors 56 and 58 due to stray electromagnetic or electrostatic fields.

The detonator actuator 24 illustrated in FIGS. 3 and 4 includes a tubular housing 176 preferably formed from aluminium. The unit includes partitions 178 and 180 which define a chamber 190 in which a circuit board 192 for electric and/or electronic components are mounted. The board 192 is supported by tabs 194 and 196 pressed from the partitions. The bus 82 extends through the chamber 190 and is connected at either end to connectors 198 and 200. One end of the housing 176 is formed with a keyed reduced diameter spigot portion 202 which in use is received in the free end of the housing 44 of the detonator unit 22. The arrangement is such that when the spigot portion 202 is interlocked with the housing 44 the connectors 198 and 108 establish appropriate connections for the various lines of the bus 82. The actuator unit 24 may include an LED 204 which can be mounted so as to be visible when illuminated from the exterior of the actuator unit 24.

The actuator unit 24 performs a variety of functions in the detonator assembly 6. Generally speaking, it ensures that the detonator unit 22 is actuated only in response to correctly received signals from the controller 14 and at an exactly defined instant of time. Other functions of the actuator unit 24 are to ensure correct operation of the other units in the assembly on interconnection of the various units and to control the operation of the transducer unit 26.

Figure 8:
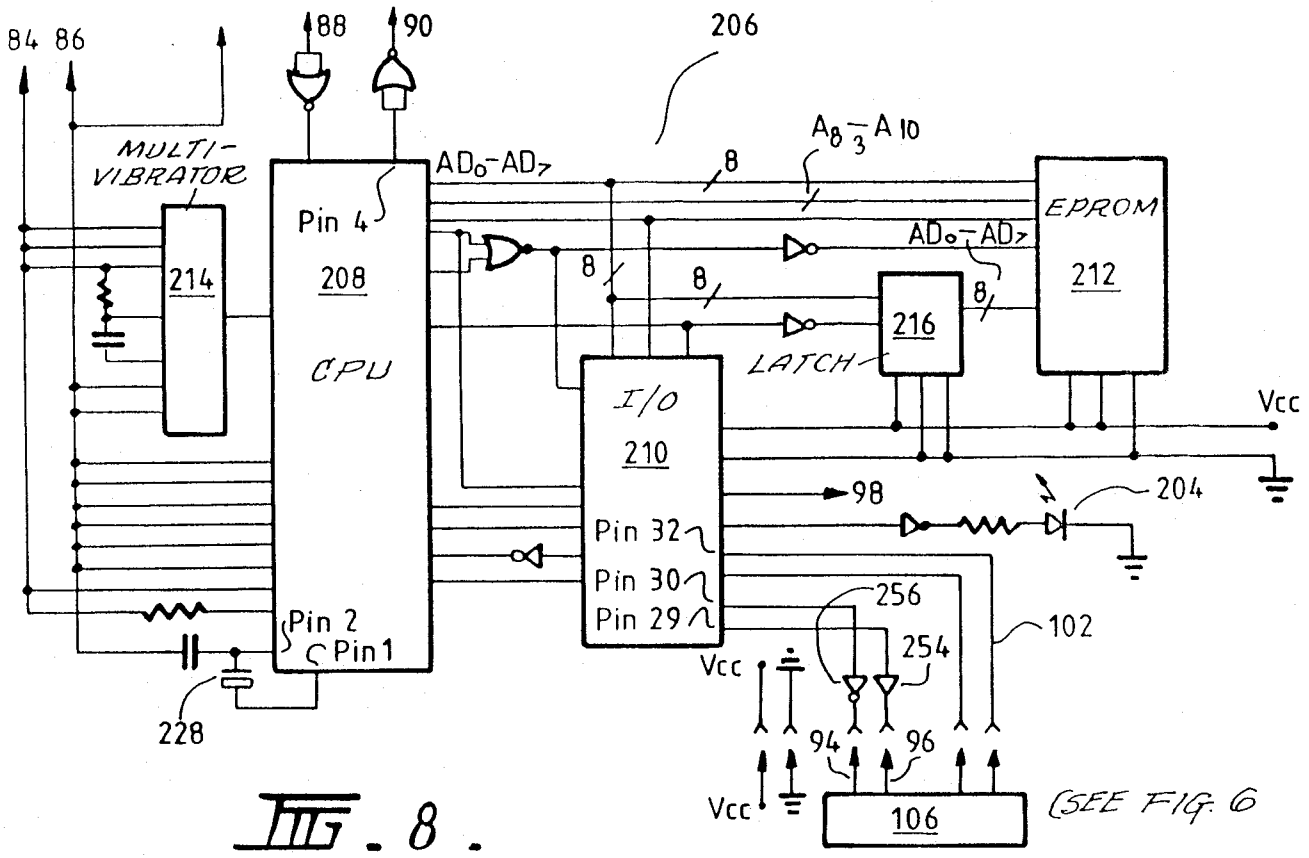
FIG. 8 is a schematic circuit diagram for an embodiment of a detonator actuator unit.

FIG. 8 shows in schematic form one arrangement for the circuitry 206 mounted on the board 192 in the actuator unit 24. The circuitry 206 generally speaking includes a microcomputer with memory to store programmes and data for correct operation of the unit 24 as well as the other units of the assembly. The data includes data relative to the precise delay required for actuation of the detonator unit 22 following generation of a blast commence signal (or BOOM command) from the controller 14. Further, the stored programme provides for calibration of a crystal clock in the circuitry 206 by the controller 14 just prior to operation. This ensures 5 a high level of accuracy of all the time based functions of the assembly 6 which is therefore not dependent upon accurately selected components in the circuit 206. Further the accuracy would not be influenced by temperatures and pressures in the blast holes 4 at a blasting site.

The circuit 206 includes an 8085 CPU 208, an 8155 input/output unit 210, a 2716 EPROM 212, a 74123 monostable retriggerable multivibrator 214 and a 74377 eight bit latch 216. The components are connected together as indicated in the connection table (FIG. 9) so as to function as a microcomputer, as known in the art.

Figure 10:
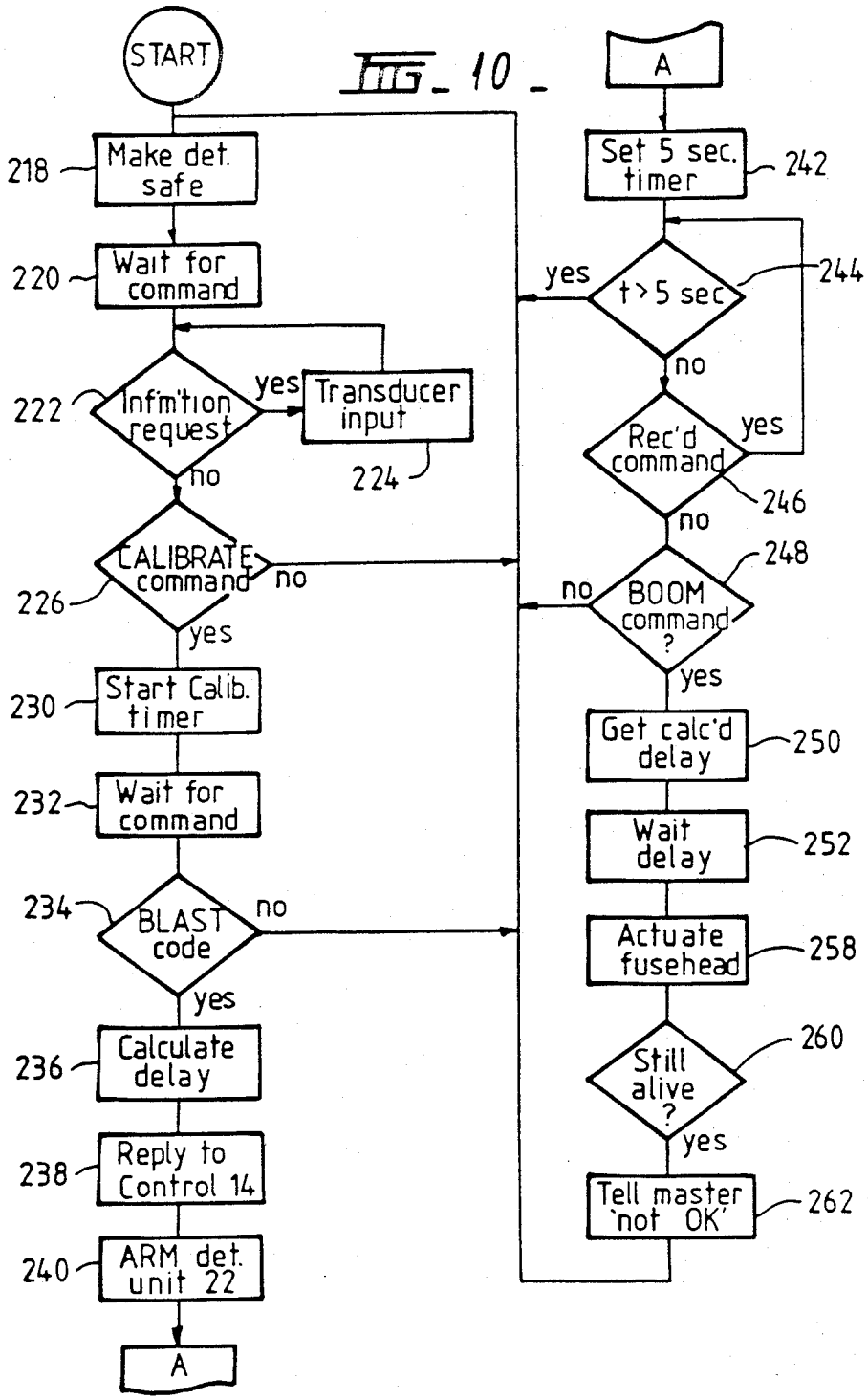
FIG. 10 is a flow diagram illustrating the operation of the detonator actuator unit of FIG. 8.

FIG. 10 shows schematically a flow chart of some of the programme functions which are carried out by the microcomputer 206. When power is supplied to the circuit by connection of the battery unit 38 in the detonator assembly 6 a power supply voltage and ground are established on the lines 84 and 86. The multivibrator circuit 214 ensures that the CPU 208 is reset on power up. The first programming function performed by the microcomputer is to ensure that the detonator units 22 are made safe. This is accomplished by sending eight consecutive zeros from pin 32 of the input/output device 210, the pin 32 being connected to the line 102. This ensures that the register 122 in the detonator 22 is initialised to zero and accordingly the unit 22 cannot be activated because of the arrangement of the logic circuitry 118. This step is indicated by the functional block 218 in FIG. 10.

Figure 12:
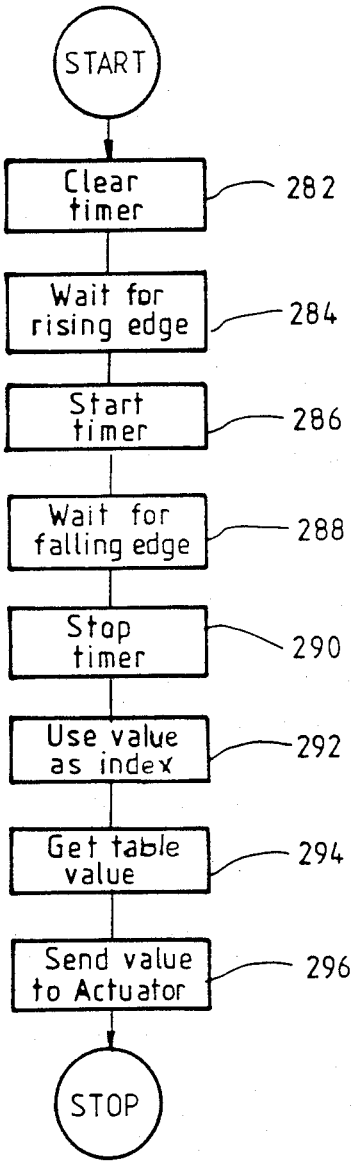
FIG. 12 is a flow diagram illustrating the operation of the transducer of FIG. 10.

After initialisation, the microcomputer waits for a command from the controller 14 as indicated by 5 programming step 220. Commands from the controller 14 are received by the connector unit 42 and are then transmitted on the line 88 of the bus 82. The command signals on line 88 preferably comprises eight bit codes in which different bit patterns represent different commands. Typical command signals would be for (a) a request for information from the transducer unit 26, (b) a CALIBRATE command to commence calibration procedures, (c) a BLAST code for arming the detonator units 22, (d) a BOOM command for exploding the units 22, or a RESET command for resetting the units 22. Accordingly, FIG. 10 shows a question box 222 which determines whether the signal on the line 88 is a request for information from the transducer unit 26. If the signal is the appropriate signal the programme will then enter a sub-routine indicated by programme step 224 to execute the transducer interrogation and transmission programme. A flow chart for this programme is shown in FIG. 12. After execution of the transducer programme, the main programme returns to the question box 222. The signal on the line 88 will then no longer be a request for information from the transducer. The programme will then pass to the next question box 226 which determines whether a signal is on the line 88 is a CALIBRATE command appropriate for commencement of calibration procedures. This is indicated in the flow chart by question box 226. If the signal is not a CALIBRATE command, the programme returns and waits for an appropriate command. Receipt of an incorrect command at any time returns the programme to the start.

When the controller 14 transmits a CALIBRATE command, this will be recognized by the programme which then commences calibration of timing of pulses derived from the crystal clock 228 connected to pins 1 and 2 of the CPU 208, as indicated by step 230 in FIG.

9. The programme then waits for a further signal on line 88 to stop counting of the pulses and to record the number of pulses counted. This is indicated by step 232 in FIG. 9. These programming steps enable the clock rate of the CPU 208 to be accurately correlated to the signals generated by the controller 14 and transmitted on the line 88 so that the actuator unit 24 can be very accurately calibrated relative to the controller 14. The controller 14 can be arranged to have a precisely defined time base so that it therefore is able to accurately calibrate a multiplicity of actuators 24 which do not have accurately selected components and would therefore not necessarily have a very accurately known time base.

Moreover, the calibration procedures can be carried out just prior to despatch of signals to activate the detonator units so as to minimize the possibility of errors owing to changing conditions of temperature and pressure or the like.

In the preferred arrangement, the signal on the line 88 to stop the timer is in fact another BLAST code generated by the controller 14, the BLAST code being selected so as to be identifiable with the particular blast e.g. user identity, date, sequential blast number, etc. The question box 234 in FIG. 10 indicates the required programming step. If the next signal received on the line 88 is not a correct BLAST code, the programme returns to the start so that recalibration will be required before the detonator unit 22 can be armed.

If on the other hand the BLAST code is correct the programme then calculates the exact delay required by the actuator 24 prior to generating signals for explosively activating the detonator unit 22. This is indicated by the programming step 236 in FIG. 10. For instance, the actuator unit 24 may be required to actuate the detonator unit 22 precisely 10 ms after a precise predetermined delay from commencement of the blasting sequence which is initiated by generation of a BOOM command by the controller 14. The information regarding the particular delay is stored in the EPROM 212 and the programme is then able to calculate the exact number of clock cycles for the microcomputer 206 required to give the precise delay. The calibration information has in the meantime been stored in RAM within the input/output device 210.

Following this step, the actuator unit 24 may signal to the controller 14 that it is functioning correctly and that appropriate signals have been received. Signals for transmission back to the controller 14 are carried by line 90 which is coupled to pin 4 of the CPU 208. This is indicated by step 238 in FIG. 10 The arming of the detonator unit 22 is indicated by step 240 in which an ARM signal is generated on pins 31 and 32 of input/output unit 210. The programme then is arranged to set a predetermined period say 5 seconds in which it must receive a BOOM command signal on the line 88 from the controller 14 for activation of the detonator unit 22. If the BOOM command signal is not received within the 5 second period, the programme returns to the start so that recalibration procedures etc. will be required in order to again be in readiness for actuation of the detonator unit 22. These programming steps are denoted 242, 244 and 246 in FIG. 10. The BOOM command signal on line 88 must be a correct eight bit pattern of signals otherwise the programme will again return to the start, as indicated by the question box 248. If the BOOM command is correct, the required delay is retrieved from the RAM in the input/output unit 210 and the delay is waited, as indicated by programming steps 250 and 252. At the end of the delay period, a signal is passed to the input/output unit 210 the output pins 29 and 30 of which go high. These output pins are connected by current drivers 254 and 256 to the lines 96 and 94 and the current drivers supply a fusehead actuating current, say 1.5 amps, required to fuse the element 62 and ignite the flashing charge 64 and thus actuate the detonator unit 22. This is indicated by the programming step 258. Actuation of the detonator unit 22 of course destroys the detonator assembly 6 so that the controller 14 will be aware of successful operation of the detonator assembly by its silence. If however there has been a malfunction, the programme includes a question box 260 which determines whether the CPU is still functioning and if so this information is communicated to line 90 for transmission to the controller 14. The programme then returns to the start whereupon the detonator unit is again made safe, this being indicated by programming steps 260 and 262.

Returning now to FIGS. 3 and 4, the transducer unit 26 comprises a tubular housing 264 preferably of aluminium and formed with a spigot portion 266 which interlocks with the open end of the housing 176 of the actuator unit 24. The shape is such that it cannot mate with the unit 22. The housing has partitions 268 and 270 which define a chamber in which a circuit board 273 for electronic and/or electrical components is located. The partitions 268 and 270 can be used to support the board 272 as well as supporting electrical connectors 272 and 274 for the bus 82. The housing 264 has an opening to permit access to a transducer element 276 which is sensitive to surrounding temperature, pressure, humidity or other parameters as required. For temperature sensing the element 276 could be bonded to the inner surface of the housing 264. The transducer unit 26 may have several transducer elements and so be responsive to a number of different parameters. Then the spigot portion 266 is interlocked with the end of the actuator unit 24, the connector 272 mates with the connector 200 so that the bus 82 extends through the respective units In its simplest configuration, the board 273 would simply carry any circuitry which might be necessary for correct operation of the transducer element 276 and for coding of its output for application to lines 98 and 100 of the bus 82.

Figure 11:
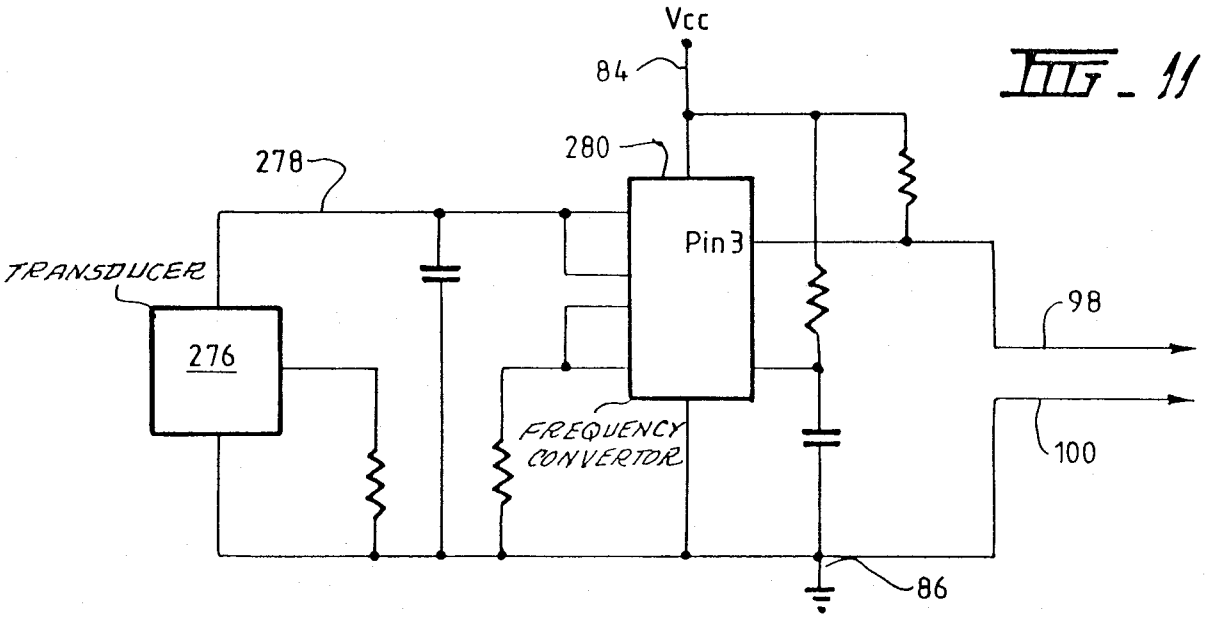
FIG. 11 is a schematic circuit diagram for an embodiment of a transducer unit.

FIG. 11 shows an example of one such circuit. In this arrangement the output 278 of the transducer element 276 is connected to the input of a voltage to frequency converter 280 which may comprise an LM 331 circuit The resistors and capacitors connected to the converter 280 are well known and need not be described in detail. Output from pin 3 of the converter 280 is connected to the line 98 of the bus, the line 100 being ground. The frequency of the signal on the line 98 will be proportional to the output of the transducer element 276 and thus be proportional to the temperature pressure humidity etc. to which the element 276 is exposed. The signal on the line 98 is applied to the CPU 208 for conversion to digital form and outputted on pin 4 which is coupled to line 90 of the bus for transmission to the controller 14.

FIG. 12 shows schematically a flow chart for processing by the microcomputer 206 of the variable frequency output signals of the transducer unit 26. The flow chart of FIG. 12 is an example of the programme denoted by 224 in FIG. 10. The first step in the programme is to clear a timer, as indicated by programme step 282. The timer may be located in the input/output unit 210. The programme then waits for the rising edge of the first received pulse on the line 98, as indicated by step 284. The programme then starts the timer and waits for a falling edge of the same pulse, as indicated by steps 286 and 288. The timer is then stopped and its value is indexed into a conversion table stored in the EPROM 212, as indicated by steps 290 and 292. The programme then looks up the value of the parameter such as temperature, pressure, etc and sends an appropriately encoded signal to the controller 14 via line 90, as indicated by steps 294 and 296. The programme then returns to the main control programme of the actuator unit 24, as indicated in FIG. 10.

In circumstances where communication from the detonator assemblies 6 to the controller 14 is not required, the connector unit 42 need only be capable of receiving signals from the controller 14 and does not need to transmit signals thereto. Thus, the unit 42 need only include a radio receiver for use with radio controlled arrangements as in FIG. 1, or line connectors for use in wire systems as shown in FIG. 2. Returning once again to FIGS. 3 and 4, the battery unit 38 comprises a tubular housing 298 with a spigot portion 300 which is interlockable with the open end of the housing 264 of the transducer unit 26. The spigot 300 is also shaped so that it can be plugged directly into the housing 176 of the actuator unit 24 in instances where the transducer 26 is not required. The shape of the spigot 300 is such that it cannot be inserted into the open end of the housing 44 of the detonator unit 22. The unit 38 includes partitions 302 and 304 which define a chamber within which a battery 306 is mounted. The battery provides the power supply on lines 84 and 86 of the bus for the other units in the assembly. In some arrangements, the battery unit 38 may be omitted by arranging for one or more of the other units such as the actuator 24 to have an inbuilt battery or to be provided with energy storage means such as a capacitor for powering the units or to have power supplied by the controller 14 itself, as on lines 86 and 84 via the lines 20. The battery unit 38 has connectors 308 and 310 to provide interconnections of the bus 82 through the unit.

Figure 13:
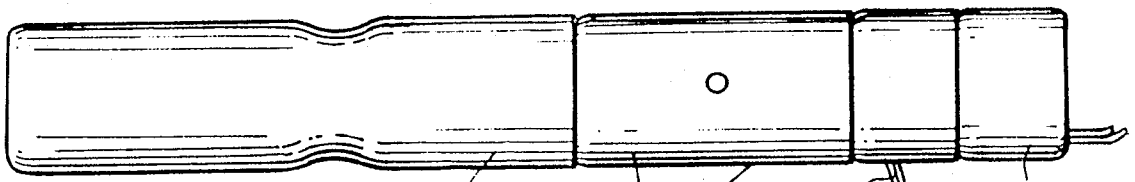
FIG. 13 is a side view of an embodiment of a detonator assembly.
Figure 14:
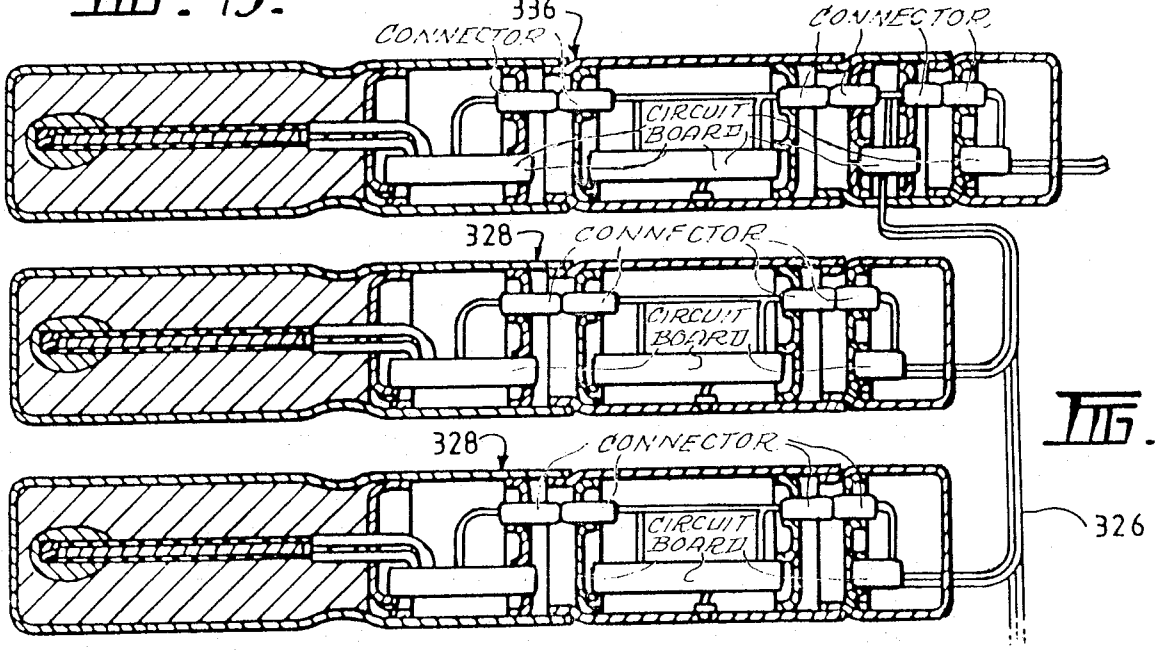
FIG. 14 shows three detonator assemblies connected for parallel operation.

FIGS. 3 and 4 also show the expander unit 40 in more detail. The expander unit comprises a tubular housing 312 formed with a spigot 314 which can be inserted into the housings of the units 38, 26 and 24 as required. The housing has partitions 316 and 318 which define a chamber in which a terminal block 320 is mounted. The partitions also support connectors 322 and 324 for the bus 82. Extending from the terminal block 320 through an opening in the housing 312 are lines 326 which can be used to connect a number of detonator assemblies in parallel, as shown in FIGS. 13 and 14. FIGS. 3 and 4 also illustrate the connector unit 42. The unit 42 comprises a tubular housing 328 with a closed end wall 330. The housing has a partition 332 which defines a chamber within which a circuit board 334 is mounted. The partition 332 also supports a connector 336. The housing 328 is formed with a spigot portion 338 which is insertable in any one of the units 40, 38, 26 and 24 and the arrangement is such that the connector 336 mates with the complementary connector of the unit to which it is connected. The unit 42 is not however directly insertable in the detonator unit 22.

The circuit board 334 in the unit 42 may comprise a connection block which connects the wires 20 from the controller 14 to the assemblies 6, as in the arrangement shown in FIG. 2. This is the simplest arrangement for the unit 42.

In another alternative arrangement for the unit 42, the board 334 may include an electronic clock and signal generator to enable activation of the actuator unit 24 independently of the controller 14. In this arrangement (not shown) the clock would control a signal generator which would generate signals for actuator unit 24 via the line 88 which signals would normally be generated by the controller 14.

In a further alternative arrangement, the unit 42 may include the radio transceiver 12 which receives signals radiated by the transmitter 15 or the safety unit 16, as in the arrangement of FIG. 1. In this instance, the lines 340 which comprise the input to the circuitry on the board 334 would comprise or be connected to an antenna for receipt of radio signals.

FIG. 13 shows a "master" assembly 336 having the transceiver 12 in the unit 42 for coupling to lines 326 to "slave" assemblies 328 for parallel operation of a number of assemblies, as shown in FIG. 14.

Figure 15:
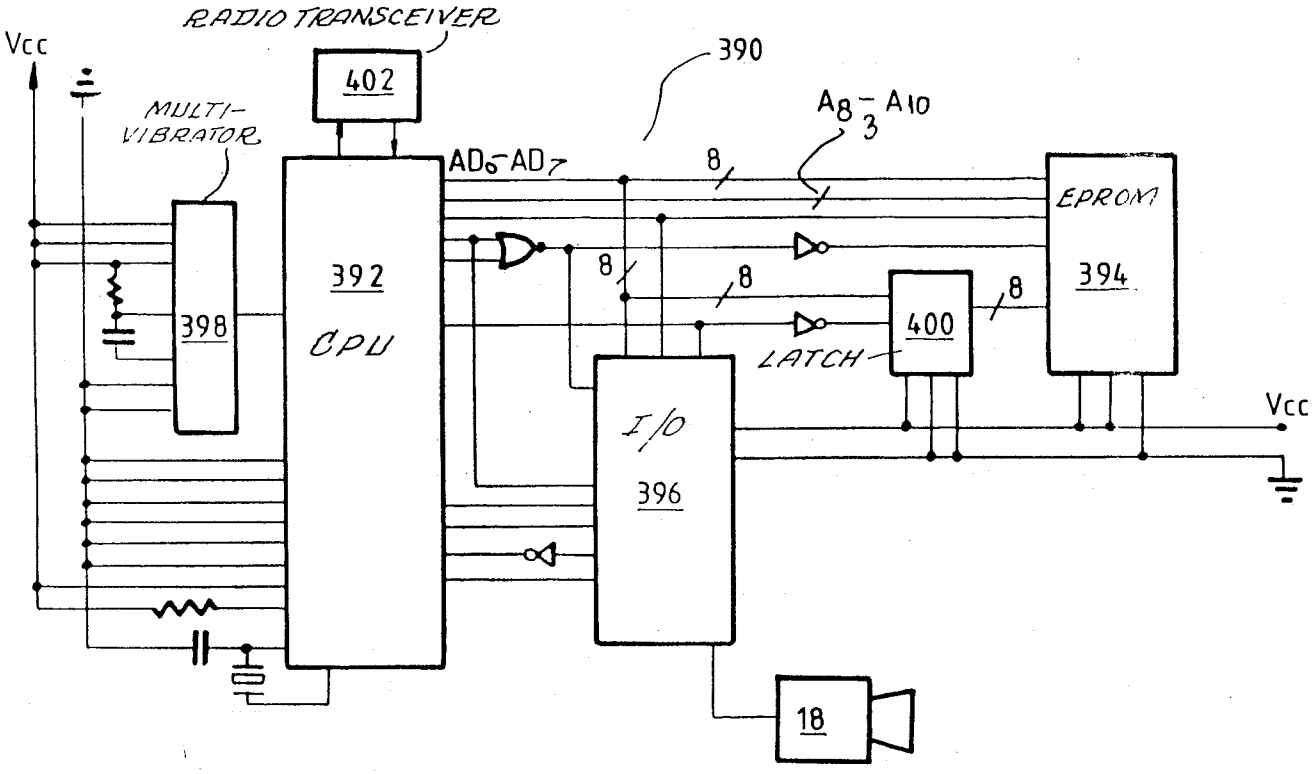
FIG. 15 is a schematic circuit diagram for an embodiment of a site safety unit.

FIG. 15 illustrates in more detail the circuitry of the site safety unit 16. The circuitry essentially comprises a microcomputer 390 comprising an 8055 CPU 392, a 2176 EPROM 394, an 8155 input/output device 396, a 74123 monostable triggerable multivibrator 398 and a 74377 eight bit latch 400. These components are connected together as indicated by the connection table(-FIG. 16)so that they function as a microcomputer as is known in the art. The principle function of the microcomputer 390 is to generate control signals for a radio transceiver 402 so as to keep the actuator units 24 reset until correctly actuated by the controller 14. This substantially eliminates inadvertent operation of the actuator assemblies by receipt of stray signals which, by coincidence, may be coded to arm, or even actuate, the actuator units 24.

A preferred mode of operation is as follows. During preparation for a blast, the very first piece of equipment to be unloaded and turned on is the site safety unit 16. In the normal idle mode with no radio transmissions detected, the unit 16 will cause the transceiver 402 to transmit RESET commands once every minute. The RESET commands are in the same format as those generated by the controller 14 and will reset all actuator units 24. This has the effect of rendering the detonator units 22 safe, that is to say in a condition in which they cannot be actuated. Resetting will occur also for any actuator unit 24 or detonator unit 22 which has been previously "armed". The transceiver 402 continuously receives radio signals on the same frequency channel as is utilised by the transceiver 15 of the controller 14. If at any time the unit 16 detects a signal identifiable as an ARM signal (or BLAST code) appropriate for the actuator unit 24, it will immediately respond by sending a RESET command and sound the siren 18 so as to warn all personnel that an explosion may be imminent. The ARM command may for instance be a particular eight or sixteen bit signal so that the likelihood of its receipt by coincidence is very slight. Nevertheless, if a transmission from an aircraft or radio telephone nearby happens to be on the correct frequency and happens to correspond exactly to the ARM code of the actuator unit 24, the safety unit 16 will detect this and will make the actuator units 22 safe again by resetting them as well as sounding the siren 18. Thus accidental actuation of the detonator assembly 6 due to random radio noise or spurious transmission is therefore virtually impossible.

When the controller 14 requires to transmit a valid blast sequence to the detonator assembly 6, it first transmits a special DISABLE command via its transceiver 15. The detonator assembly 6 will not respond to the DISABLE command The safety unit 16 will however recognise the signal and will consequently disable its own transceiver 402 thereby leaving the radio channel quiet for the transceiver 15 of the controller 14 to finish the blast sequence When the unit 16 detects the ARM command transmitted by the transceiver 15 as part of this valid sequence, it will cause the siren 18 to be actuated.

It is important to note that there is no physical connection between the unit 16 and the controller 14 so that any malfunction of the controller 14 should not simultaneously cause a fault in the safety unit 16.

Figure 17:
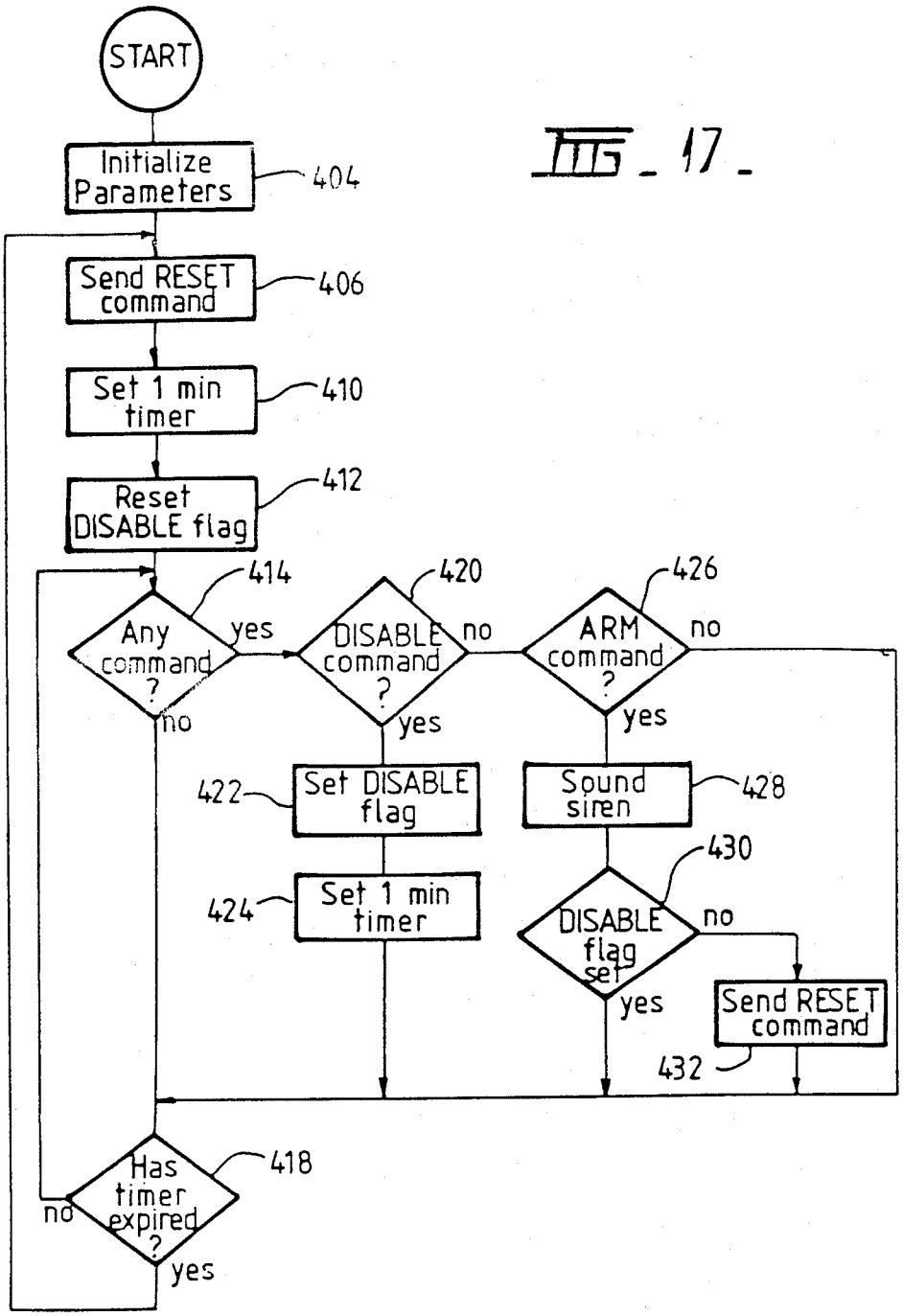
FIG. 17 is a flow diagram illustrating the operation of the site safety unit of FIG. 15.

FIG. 17 is a flowchart illustrating the important programming steps which are carried out by the microcomputer 390. On power up, the multivibrator 398 ensures that the CPU 392 is correctly initialised. Thereafter the computer 390 will operate and run the programme stored in the EPROM 394. The first programming step 404 is to initialise various parameters. The next step 406 is to send a RESET command. The RESET command is transmitted via output line 408 to the transceiver 402 for transmission to the actuator assemblies 6. The next programming step 410 is to set an internal timer (not shown) which for instance resets at a predetermined period say one minute. The inbuilt timer provided in the input/output unit 396 can be used for this purpose. The next programming step 412 is to reset a DISABLE flag which is actuated when a DISABLE command is received. Thereafter the programme passes to question box 414 which determines if any radio signal has been received by the transceiver 402 and communicated to the CPU 392 via input line 416. If no recognisable signal has been received, the programme will effectively wait until the pre-determined period of one minute has elapsed, as indicated by question box 418. Once the period has elapsed, the programme will return to step 406 and again send the RESET command. Thus, whilst no recognisable signals are received by the transceiver 402, the CPU will cause RESET signals to be transmitted once every minute, thereby keeping the detonator assemblies 6 safe.

If a recognisable signal is received, the programme will determine whether it is a DISABLE command from the controller 14, as indicated by question box 420. The DISABLE command is transmitted by the controller 14 when a valid blast sequence is required. So if the DISABLE command is received, the programme sets the DISABLE flag and restarts the internal timer, as indicated by programming steps 422 and 424. The programme then determines whether the timer has expired, as indicated by step 418. If the timer has not expired, the programme will return to question box 414. This is really a waiting period for one minute to see whether any valid commands are received from the controller 14. If a signal is in fact received, it will be interrogated to see whether it is a DISABLE command as indicated by box 420 or an ARM command as indicated by box 426. If the signal is not an ARM command, the programme will return to the question box 418 which enquires whether the timer has expired. If an ARM command has been received, the programme will cause the siren 18 to be actuated, as indicated by step 428 and then pass to question box 430 which determines whether the DISABLE flag has been set. If it has, the programme returns to the question box 418. If it has not, it will send a RESET command, as indicated by step 432. This is an important safety function of the system in that RESET commands will be sent if an ARM command is received out of sequence, that is to say, before receipt of a valid DISABLE command.

Figure 18:
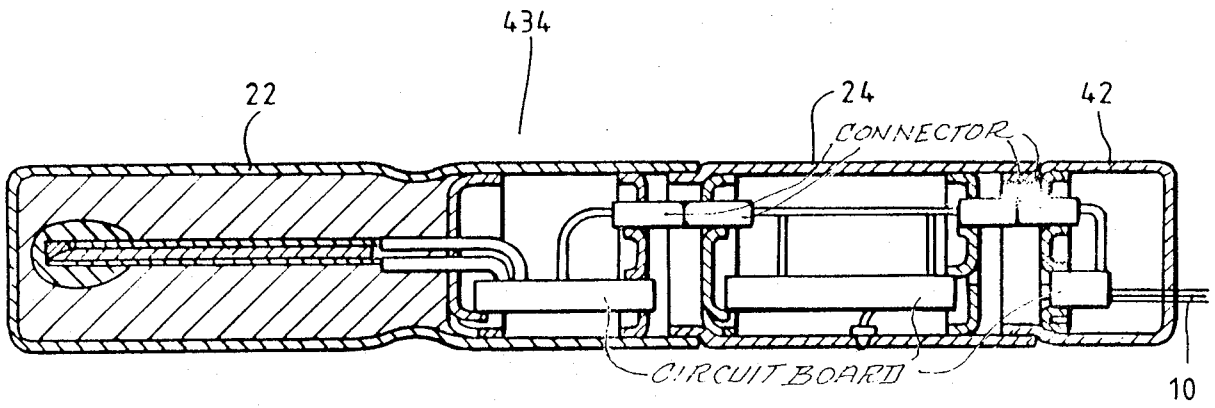
FIG. 18 is a sectional view through an embodiment of a detonator assembly.

FIG. 18 shows a detonator assembly 434 comprising a detonator unit 22, actuator unit 24 and connector unit 42. In this arrangement the connector unit 42 is arranged for connection to the controller 14 by the conductors 10 and wires 20, as in FIG. 2. The detonator assembly 434 receives power directly from the controller 14 and to be actuated at a predetermined interval after voltage has been disconnected from the wires 20. In a blast using these assemblies, it would not matter if the wire 20 or conductors 10 were broken by actuation of assemblies which have been actuated earlier since the assemblies have their own power supplies and will be actuated at a predetermined period after the voltage has been disconnected regardless of whether the conductors 10 or wires 20 remain intact.

Figure 19:
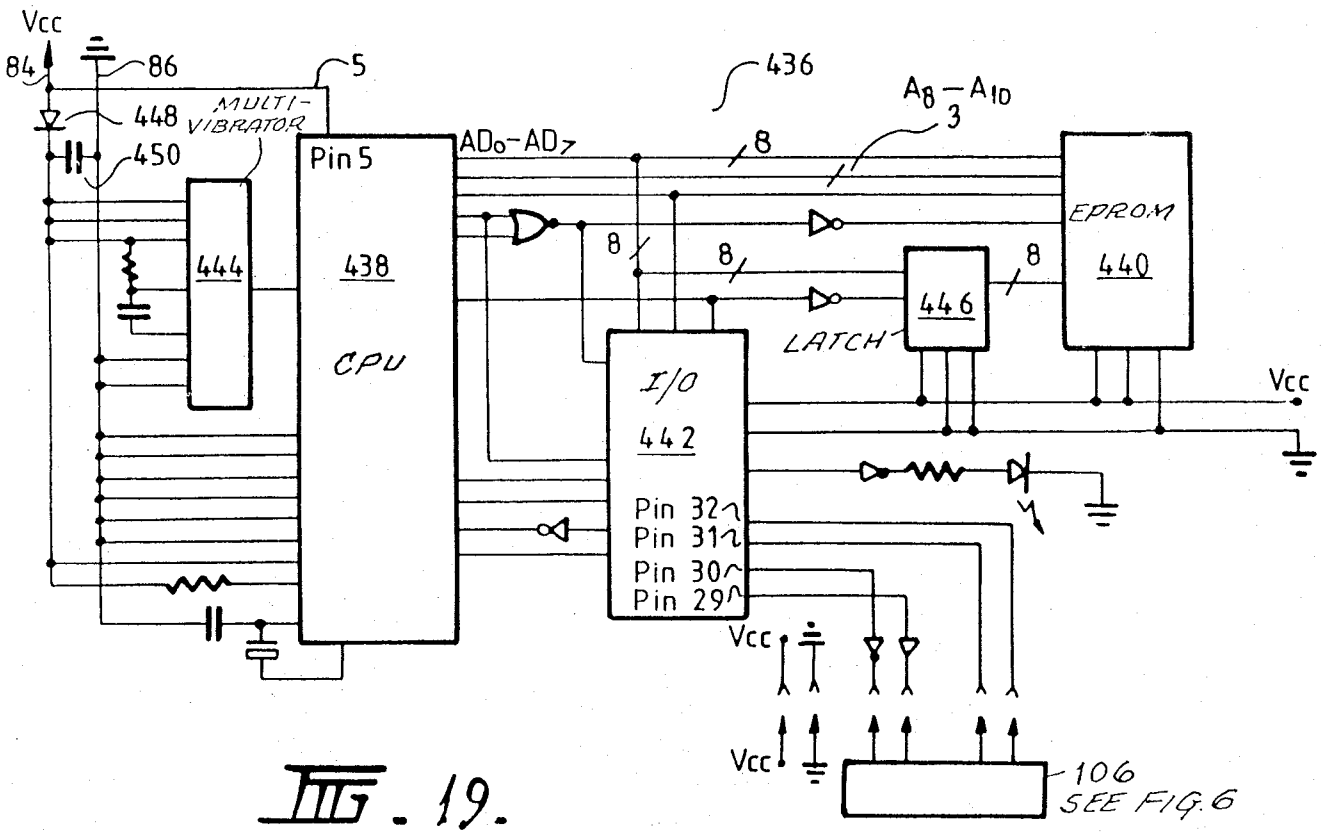
FIG. 19 is a schematic circuit diagram for an embodiment of a detonator actuator unit suitable for use with assemblies as shown in FIG. 18.

FIG. 19 illustrates in more detail the circuitry for the actuator unit 24 of assembly 434. The circuitry essentially comprises a microcomputer 436 comprising an 8085 CPU 438, a 2176 EPROM 440, an 8155 input/output device 442, a 74123 triggerable multivibrator 444, and a 74377 eight bit latch 446. These components are connected together as indicated by the connection table (FIG. 20) so that they function as a microcomputer as is known in the art. The principle function of the microcomputer 436 is to generate control signals which are used to control the detonator assembly 436. In this arrangement, the power supply line 84 and ground line 86 are connected to the conductors 10 so as to establish direct connection to the controller 14. The voltage on the power supply line 84 charges a storage capacitor 450. The diode 448 ensures that the "power sense" line can detect the discontinuation of power from the controller 14 on line 84 even while the capacitor 450 maintains the actuator 436 on. The capacitor 450 is chosen so that it will have sufficient charge to power the circuitry for the microcomputer 436 after the voltage supply level has been removed from supply line 84. As soon as the multivibrator 444 operates after power on, it will properly initialise the CPU 438. The input pin 5 of the CPU is connected to the line 84 so as to indicate a "power up". After power up, the microprocessor 436 will operate to generate an ARM command which is communicated via pins 31 and 32 of the unit 472 to the detonator unit 22. The CPU 438 will then wait until the voltage falls to zero or below a predetermined level on line 84, and, after a predetermined period, the fusehead actuating current will be generated to initiate the flashing charge 64 via pins 9 and 30 to cause activation thereof.

Figure 21:
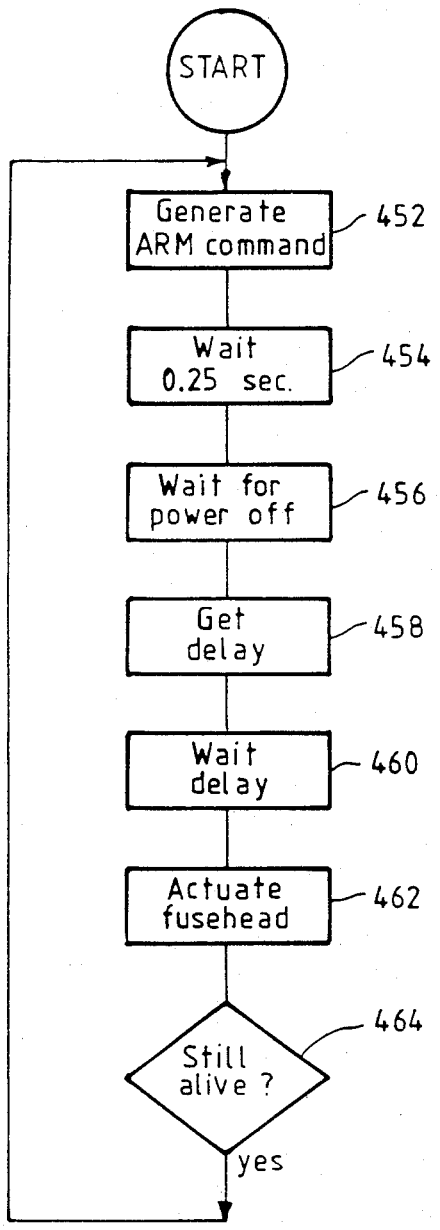
FIG. 21 is a flow chart illustrating the operation of the circuit shown in FIG. 19.

FIG. 21 is a flowchart illustrating the important programming steps which are carried out by the microcomputer 436. The programme starts on power up and then immediately generates an ARM command, as indicated by step 452, for the detonator unit 22. The ARM command will then wait for a predetermined period say 0.25 seconds before taking any other action. This prevents premature operation of the system as the result of transients or the like which might occur shortly after power up, and allows time for mechanical relays in the detonator unit 22 to switch. This step is indicated by programming step 454. The programme then waits for the voltage to fall on line 84, as indicated by step 456. When the voltage on line 84 falls to zero or below a pre-determined level the CPU will then wait a pre-determined delay so that the detonator assembly 434 will be actuated in the correct sequence relative to other assemblies This is indicated by programming steps 458 and 460 representing retrieval of the delay period from the EPROM 440 and thereafter waiting the delay period. At the end of the delay period, the programme then causes generation of the fusehead actuating current for actuation of the detonator unit 22, as indicated by step 462. The programme then passes to a question box 464 which ascertains whether the programme is still operating indicating whether the detonator unit 22 has been successfully actuated or not. If it has not, it will return to the step 452. Many modifications will be apparent to those skilled in the art. For instance, integration techniques could be used to integrate circuits which are shown in non-integrated form.

INDUSTRIAL APPLICABILITY

As will be evident from the foregoing description, my invention is useful in the field of commercial blasting. The detonators according to my invention permit the achievement of a combination of versatility economy, security, safety and ease of use which is not possible using the detonators and ancillary equipment currently available. The detonators of my invention can be made without difficulty using standard equipment and techniques currently used in the explosives and electronics industries, and their use in the field is straightforward.

I claim:

1. A detonator system responsive to a predetermined input signal from a control device comprising:

housing means;

an explosive charge disposed within said housing means;

fusehead connectors extending from said explosive charge;

conditioning means in said fusehead connectors for placing said fusehead connectors in one of a normal sate and an armed state so that when in said normal state said fusehead connectors are incapable of carrying a voltage or current sufficient to cause explosion of said explosive charge and when in said armed state said fusehead connectors can carry said voltage or current sufficient to cause explosion of said explosive charge;

control means for changing said conditioning means from said normal state to said armed state upon input of an output arm signal; and an actuator in close proximity to said conditioning means and said control means including:

means for inputting a predetermined input signal from said control device, means for generating said output arm signal upon input of said predetermined input signal to cause said control means to change from said normal to said armed state, and means for generating an output actuate signal to cause explosion of said explosive charge a predetermined period after input of said predetermined input signal.

2. A detonator according to claim 1, wherein conditioning means which render the fusehead connectors incapable of carrying a voltage or current in said normal state comprises a short circuit.

3. A detonator according to claim 1, wherein the conditioning means comprises a relay which in said normal state short circuits the fusehead connectors and which in said armed state forms an electrical link which allows the fusehead connectors to carry a voltage or current sufficient to cause explosion of the explosive charge.

4. A detonator according to claim 1, wherein the conditioning means comprises fusible links which form part of a short circuit, these being fused to break the short circuit and to render the detonator in said armed state.

5. A detonator according to claim 1, wherein the control means comprises electronic logic circuitry.

6. A detonator according to claim 1, wherein the control means and the actuator are integral.

7. A detonator according to claim 1, wherein the control means and the actuator are separate.

8. A detonator according to claim 7, wherein the control means is housed in the detonator housing and the actuator is housed in a separate housing electrically connectable thereto.

9. A detonator according to claim 8, wherein the detonator and the actuator are housed in separate modular housings which are connectable together such that the making of the connection establishes all the appropriate electrical connections between control means and actuator.

10. A detonator according to claim 1, wherein the electronic circuitry of the actuator comprises a microcomputer with a memory which stores an arm and an actuate code, the microcomputer analyzing input signals and, on receiving said predetermined signal, generating said output arm and actuate signals using said arm and actuate codes.

11. A detonator according to claim 1, wherein the predetermined input signal applied to the actuator is a voltage step signal wherein the leading edge of the predetermined input signal comprises an input arm signal and the trailing edge an input actuate signal.

12. A detonator according to claim 1, wherein the predetermined input signal is in binary code.

13. A detonator according to claim 10, wherein the predetermined period is programmable.

14. A detonator according to claim 13, wherein said predetermined period can be programmed into said microcomputer by inputting a delay calibrate input signal from said control device after said detonator is in place in a blasthole.

15. A detonator according to claim 1, wherein power to drive the detonator once output arm and actuate signals have been received is derived form a temporary power source located in close proximity to the detonator.

16. A detonator according to claim 15, wherein the temporary power source is a capacitor charged by signals from the surface.

17. A detonator according to claim 15 wherein the temporary power source is housed in a modular housing which is connectable to an actuator housing such that the making of the connection establishes all the appropriate electrical contacts between temporary power source and actuator or detonator.

18. A detonator according to claim 1, wherein said actuator has a delay timer which is calibrated by means of calibration signals.

19. A detonator according to claim 7 wherein the detonator includes a transducer unit couplable to at least the actuator, the transducer unit comprising at least one transducer element which is responsive to a preselected physical parameter and is operable to generate condition signals related to the said parameter.

20. A detonator according to claim 19 wherein the condition signals from the transducer unit and any action taken as a result thereof are communicated to the surface.

* * * * *